US005276943A

United States Patent [19]

Ludy

[11] Patent Number: 5,276,943

[45] Date of Patent: Jan. 11, 1994

[54] PAINT CAN HANDLE

[76] Inventor: Andrew W. Ludy, 17 Sherwood Way, Landing, N.J. 07850

[21] Appl. No.: 859,842

[22] Filed: Mar. 30, 1992

[51] Int. Cl.[5] ..... B65D 25/28

[52] U.S. Cl. ..... 16/126; 16/125; 220/756; 220/770; 248/211

[58] Field of Search .... 16/114 R, 120, 125, 126, 127; 182/129; 220/756, 759, 770, 773; 248/210, 211

[56] References Cited

U.S. PATENT DOCUMENTS

| | | | |
|---|---|---|---|
| 930,824 | 8/1909 | Wood | 16/126 |
| 1,024,841 | 4/1912 | Emery | 248/211 |
| 1,528,230 | 3/1925 | White | 16/126 |
| 1,610,200 | 12/1926 | Campbell | 16/126 |
| 2,508,258 | 5/1950 | Heinrich | 220/756 |
| 4,023,702 | 5/1977 | McKnight | 16/126 |
| 4,205,411 | 6/1980 | Cupp et al. | 220/156 |
| 4,335,487 | 6/1982 | DiPierro et al. | 16/126 |
| 5,062,607 | 11/1991 | Kisner | 248/211 |

*Primary Examiner*—W. Donald Bray
*Attorney, Agent, or Firm*—Andrew W. Ludy

[57] ABSTRACT

A handle for a paint can suspends the can securely from a ladder rung in a stationary mode in either an upright position with the can full of paint and the bottom resting upon an adjacent lower rung, or in an inclined position for easier access with the can partially full and the front wall resting against an adjacent lower rung, and includes a transverse hand grip member connected between two side supporting members having elongated vertical elements, straight horizontal elements, and dependent vertical elements, forming a hook structure to engage the ladder rung, and being pivotally attached to the can so that the handle may be folded against the can for storage.

18 Claims, 6 Drawing Sheets

PAINT CAN HANDLE

BACKGROUND OF THE INVENTION

The present invention relates generally to handles for lifting and supporting containers and pertains, more specifically, to a handle or bail for a paint can to suspend the can securely from a ladder rung without an intervening S-hook.

The state of the art in hanging a paint can from a ladder consists of engaging the ladder rung with a single accessory hook from which the paint can is hung. Moving the can entails reaching around behind the ladder to hook or unhook the can. This procedure risks dropping the can or the hook, or losing one's balance and falling off the ladder. Another difficulty arises in reaching between the ladder rungs to insert a brush into the can hung behind the ladder. Additionally, striking excess paint from the brush against the rim of the can causes it to gyrate awkwardly about its single point of suspension.

Handles for suspending a paint can directly from a ladder rung without an accessory hook are unknown in the prior art. Handles for suspending a clothespin container from a clothesline are known and have assumed a number of configurations in the past. Some examples of container handles of this type in the prior art are found in the following United States patents:

Ricketts, U.S. Pat. No. 1,567,677; Mabon, U.S. Pat. No. 1,427,219; McRoberts, U.S. Pat. No. 1,461,802; and Costigan, U.S. Pat. No. 1,989,473; all illustrate a handle for a clothespin bag having a horizontal hand grip portion, two inserted U-shaped hooks to engage a clothesline, and side support members attached to the bag.

These inventions are not designed to engage a ladder rung which is much larger than a clothesline and is flat on top. They all feature semicircular inverted hooks to engage a round clothesline, and which would be unstable on a flat ladder rung, allowing the container to swing about. Ricketts describes two "inverted U-shaped loops," which "have a width sufficient for the support to engage the ordinary clothesline," which is about one quarter inch in diameter. None of these prior art devices would fit on an extension ladder rung, which is at least one and one half inches across, or on a step ladder rung, which is four inches across. Also, the side support members must be spaced apart a given distance to engage the side support trunnions of a standard paint can, which are spaced apart the given distance. In none of the above-mentioned references is this critical given distance suggested. Furthermore, as the container is suspended from a ladder rung, is should rest upon or against the next lower rung. In none of the prior art inventions is the combination of handle and container configured to provide additional support and stability from the adjacent lower rung touching the bottom or side of the container. Additionally, the prior art devices show no structure for retaining the hooks on the clothesline against accidental disengagement by bumping.

SUMMARY OF THE INVENTION

It is therefore an object of the present invention to provide a handle for a paint can that will engage a ladder rung directly to suspend the can securely from the rung without an intervening accessory hook.

Another object of the invention is to provide a handle for a paint can of the type described and which will allow the can to be suspended or removed from the front of the ladder without reaching around behind the ladder.

Yet another object of the invention is to provide a handle for a paint can of the type described and which will suspend the can from two points for stability.

Still another object of the invention is to provide a handle for a paint can of the type described and which will suspend the can between two adjacent ladder rungs with the mouth of the can near the front of the ladder so that a painter will insert a brush into the can without reaching between the rungs.

Even another object of the invention is to provide a handle for a paint can of the type described and which includes a straight element to enable secure engagement with the flat surface of the rung of the ladder for greater stability.

A further object of the invention is to provide a handle for a paint can of the type described and which will suspend the can from a ladder rung with the bottom of the can resting upon the adjacent lower rung to further support and stabilize the can in an upright position so that the painter will strike excess paint from the brush against the rim of the can when it is full without moving the can or spilling paint.

A still further object of the invention is to provide a handle for a paint can of the type described and which will suspend the can from a ladder rung with the front wall of the can resting against the adjacent lower rung to further stabilize the can in an inclined position so that the painter will stroke excess paint from the brush against the rim of the can when it is partially full without moving the can or spilling paint.

Yet a further object of the invention is to provide a handle for a paint can of the type described and which will suspend the can from a ladder rung in an inclined position with the front wall of the can resting against the adjacent lower rung to tilt the mouth of the can toward the front of the ladder to facilitate insertion of the brush into the mouth of the can.

An even further object of the invention is to provide a handle for a paint can of the type described and which will suspend the can from a ladder rung in an inclined position to bring the liquid level of a partially full can close to the front rim of the can for easier access thereto.

An additional object of the invention is to provide a handle for a paint can of the type described and which will retain the hook structure on the ladder rung against accidental disengagement by bumping.

A still additional object of the invention is to provide a handle for a paint can of the type described and which will pivot from a lower position wherein the handle is folded against the can for storage to an upper position wherein the can is suspended from the rung for use.

Yet an additional object of the invention is to provide a handle for a paint can of the type described and which is easy to use under a wide variety of conditions in the field.

An even additional object of the invention is to provide a handle for a paint can of the type described and which has a simplified configuration capable of economical manufacture in large numbers of high quality.

One more object of the invention is to provide a handle for a paint can of the type described and which is rugged in construction so as to provide reliable performance during it's service life.

The above objects, as well as further objects and advantages, are attained by the present invention which may be described briefly as a handle for use in connection with a paint can having two opposite side support trunnions spaced apart a given distance to suspend the paint can from a ladder rung having a predetermined width the handle comprising: a pair of suspending members spaced apart the given distance between the trunnions, the pair of suspending members establishing a hook structure for securely engaging the ladder rung to suspend the can from the ladder rung, the pair of suspending members including a pair of elongated elements, disposed generally vertically, each having opposite upper and lower ends; a pair of generally horizontal intermediate elements, of sufficient length to straddle the width of the ladder rung, each intermediate element having first and second opposite ends, the first ends being attached to the upper ends of the elongated elements; a pair of generally vertical dependent elements connected to the second ends of the intermediate elements; pivotal means for pivotal attachment of the lower ends of the elongated elements to the trunnions so that upon such attachment the handle will be pivoted from a lower position wherein the handle is folded against the can for storage to an upper position wherein the can is suspended from the rung for use; a transverse member disposed horizontally between the suspending members and connecting the suspending members to establish a hand grip portion for enabling grasping of the handle and lifting of the can.

BRIEF DESCRIPTION OF THE DRAWING

The invention will be more fully understood, while still further objects and advantages will become apparent, in the following detailed description of preferred embodiments thereof illustrated in the accompanying drawing, in which.

DESCRIPTION OF THE PREFERRED EMBODIMENTS

Figure 1:
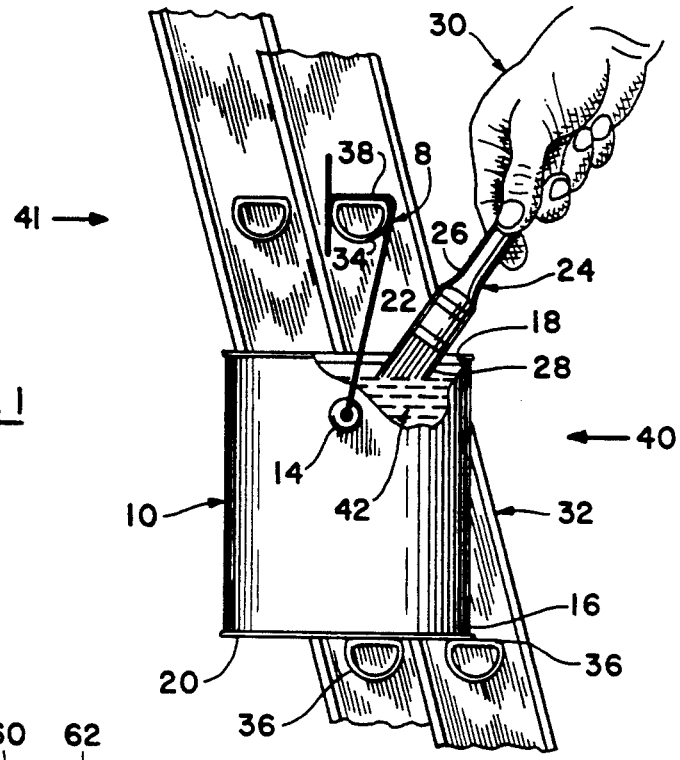
FIG. 1 is a side elevational view of a ladder cut in section vertically to show a paint can suspended from a rung in an upright position by a handle constructed in accordance with the invention.
Figure 4:
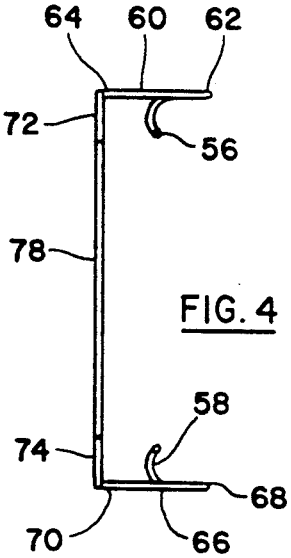
FIG. 4 is a top view of the handle of FIG. 1.
Figure 5:
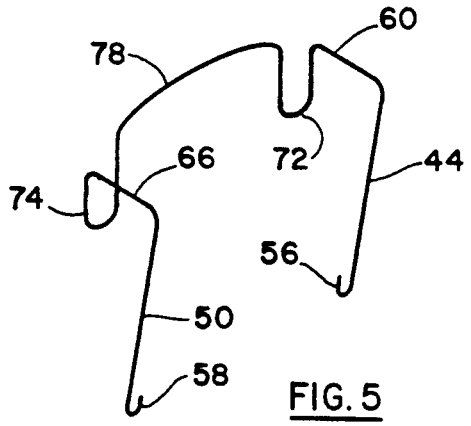
FIG. 5 is an isometric view of the handle of FIG. 1.
Figure 3:
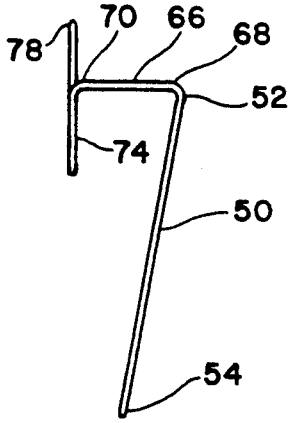
FIG. 3 is a left side view of the handle of FIG. 1.
Figure 2:
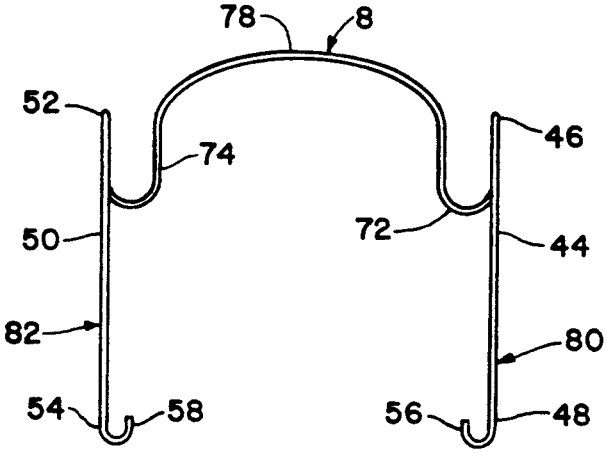
FIG. 2 is a front elevational view of the handle of FIG. 1.
Figure 6:
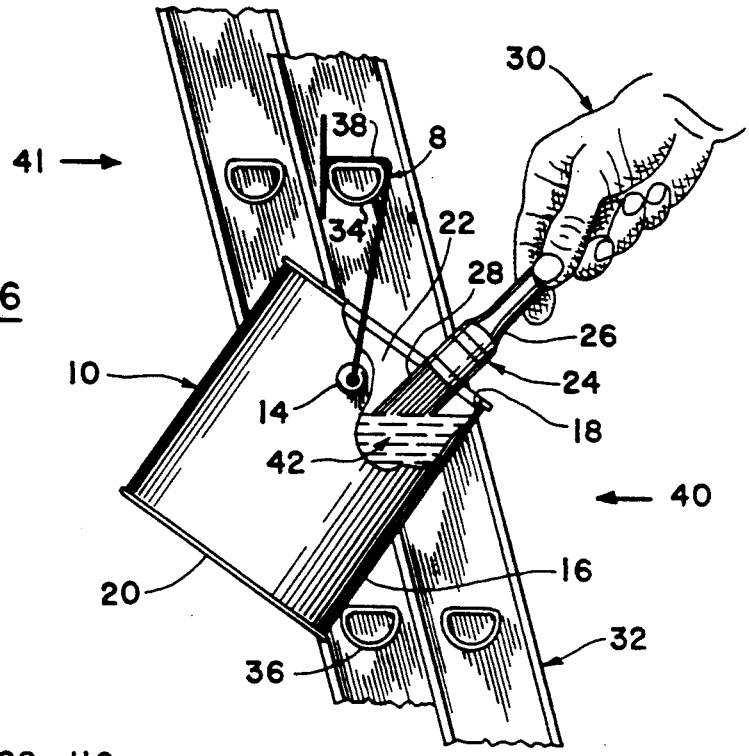
FIG. 6 is a side elevational view of the ladder cut in section vertically to show the paint can suspended from the rung in an inclined position by the handle of FIG. 1.
Figure 9:
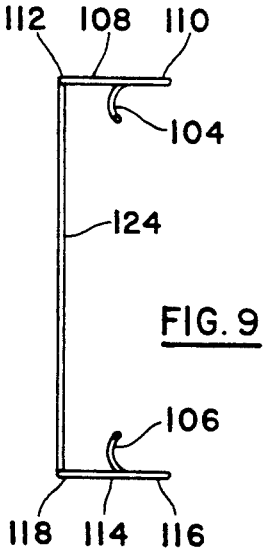
FIG. 9 is a top view of the handle of FIG. 7.
Figure 10:
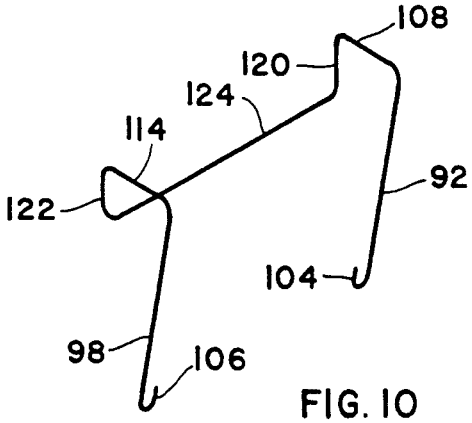
FIG. 10 is an isometric view of the handle of FIG. 7.
Figure 8:
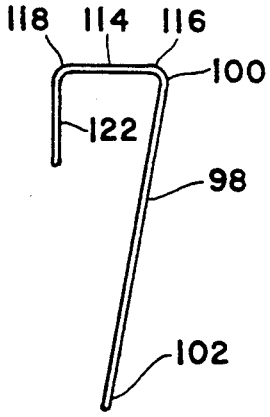
FIG. 8 is a left side view of the handle of FIG. 7.
Figure 7:
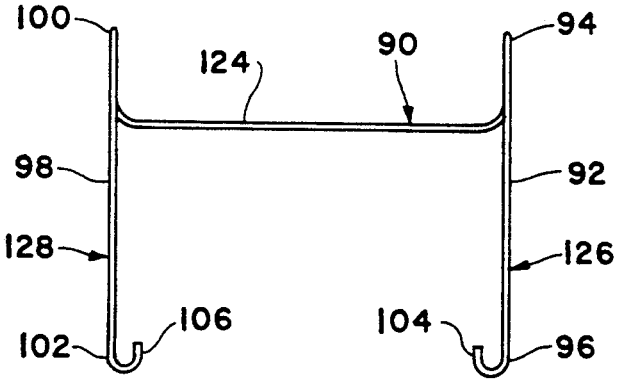
FIG. 7 is a front elevational view of another handle constructed in accordance with the invention.
Figure 11:
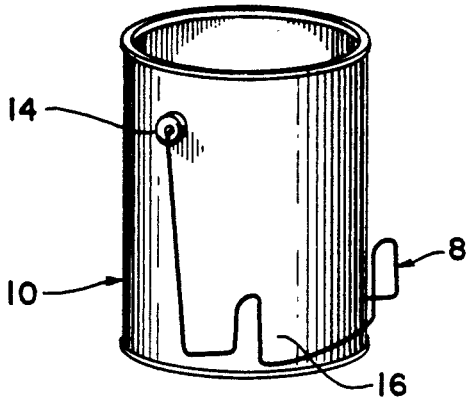
FIG. 11 is a perspective view of the paint can with the handle of FIG. 1 folded down against the frontwall of the can.

Referring now to the drawing, and especially to FIGS. 1, 6, 11, and 12, a paint can handle constructed in accordance with the invention is shown at 8 pivotally attached to trunnions 12 and 14 of a paint can 10, the trunnions 12 and 14 being spaced apart a given distance. The paint can 10 also includes a front wall 16, a front rim 18, a bottom 20, and a mouth 22. In FIGS. 1 and 6, the handle 8 is shown engaging a rung 34 of an extension ladder 32 to suspend the can 10 from the rung 34. The rung 34 includes a flat surface 38. The handle 8 is installed upon rung 34 from the front of the ladder 32, as shown by arrow 40. It is thus not necessary to reach around to the rear of the ladder 32 as shown by arrow 41 to install the handle 8 upon the rung 34 or to remove the handle 8 from the rung 34. In FIG. 1 the bottom 20 of the can 10 is supported by an adjacent lower rung 36 of the ladder 32 to stabilize the can 10 in an upright position to preclude spilling paint 42 when the can 10 is full of paint 42. A paintbrush 24, having a handle 26 and bristles 28 and held in the painter's hand 30, is inserted into the mouth 22 of the can 10 and partly submerged in the paint 42. This is easily done without reaching between the rungs 34 and 36 because the invention places the mouth 22 of the can 10 near the front 40 of the ladder 32, as shown in FIG. 1. The brush 24 is then with drawn from the can 10 drawing the bristles 28 against the front rim 18 to strike excess paint 42 from the bristles 28. This action does not tip the can 10 and spill paint 42 by virtue of the support of the bottom 20 of the can 10 by the adjacent lower rung 36. In FIG. 6, the front wall 16 of the can 10 is resting against the adjacent lower rung 36 to stabilize the can 10 in an inclined position to preclude tipping the can 10 and spilling paint 42 when the can 10 is partially full of paint 42 and excess paint 42 is struck from the bristles 28 against the rim 18. This inclined position further tilts the mouth 22 of the can 10 toward the front 40 of the ladder 32 to provide easier access to the can 10. The inclined position also raises the level of the paint 42 closer to the front rim 18 for easier access to the paint 42. In FIG. 11 the handle 8 is shown folded down against the front wall 16 of the can 10 for storage, by means of the pivotal attachment at the trunnions 12 and 14. A plurality of cans 10 may be packed in close proximity as for shipping and storage, since the handles 8 occupy a minimum amount of space in this folded position.

Figure 12:
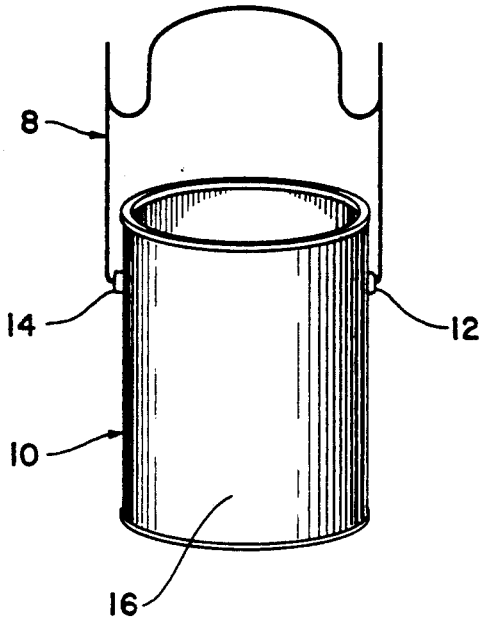
FIG. 12 is a perspective view of the paint can with the handle of FIG. 1 raised in position for use.
Figure 15:
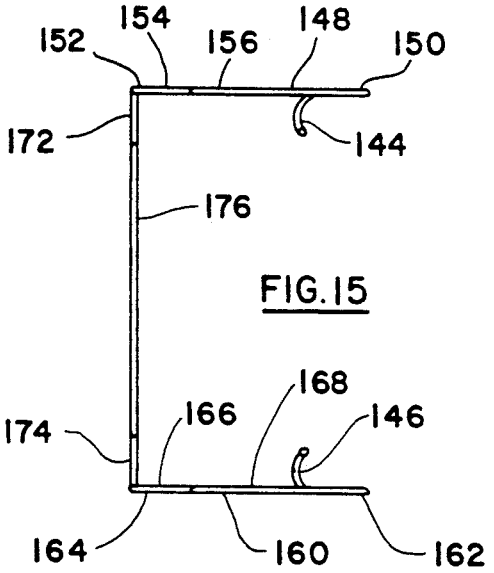
FIG. 15 is a top view of the handle of FIG. 13.
Figure 16:
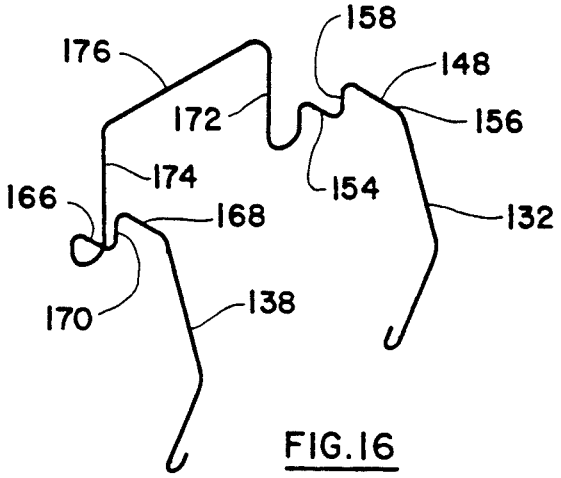
FIG. 16 is an isometric view of the handle of FIG. 13.
Figure 14:
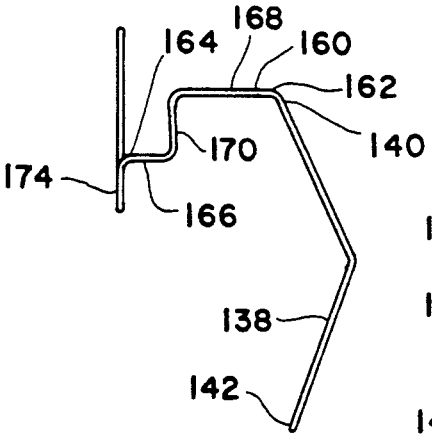
FIG. 14 is a left side view of the handle of FIG. 13.
Figure 13:
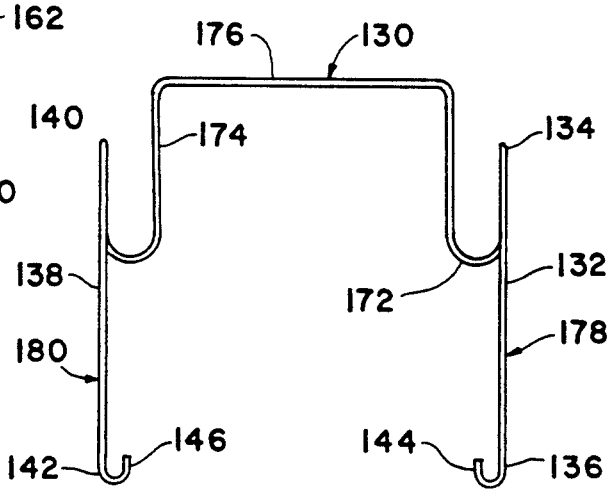
FIG. 13 is a front elevational view of still another handle constructed in accordance with the invention.

Turning now to FIGS. 2 through 5, as well as to FIGS. 1, 6, 11 and 12, handle 8 includes a pair of elongated elements 44 and 50, that are generally parallel to each other, and thus lie in the same plane, and are disposed generally vertically when the handle 8 is suspended from the ladder rung 34 for use. Elongated elements 44 and 50 have upper ends 46 and 52 and opposite lower ends 48 and 54 to which are attached hook-shaped elements 56 and 58 comprising pivotal means for pivotal attachment that engage the trunnions 12 and 14 respectively of the can 10 so that the handle 8 will lift and support the can 10, and yet the handle 8 will be pivoted from a lower position wherein the handle 8 is folded against the can 10 for storage as shown in FIG. 11, to an upper position away from the can 10, as shown in FIGS. 1, 6, and 12, wherein the can 10 is suspended from the rung 34 for use. Intermediate element 60 has first end 62 and opposite second end 64. The first end 62 is attached to the upper end 46 of elongated element 44. Intermediate element 66 has first end 68 and opposite second end 70. The first end 68 is attached to the upper end 52 of elongated element 50. Each intermediate element of the pair of intermediate elements 60 and 66 is at least one and one-half inches (38 mm) in length in order to straddle the width of the ladder rung 34. The intermediate elements 60 and 66 are disposed generally horizontally and are generally parallel to each other. The intermediate elements 60 and 66 are straight, to enable secure engagement with the flat surface 38 of the rung 34 of the ladder 32. The flat surface 38 is typical of modern extension ladder rungs and has a predetermined width. Dependent element 72 is connected to second end 64 of intermediate element 60. Dependent element 74 is connected to second end 70 of intermediate element 66. The dependent elements 72 and 74 are U-shaped and generally vertical, and lie within the same plane. Transverse member 78 is disposed horizontally above the second ends 64 and 70 of intermediate elements 60 and 66. The transverse member 78 is connected between the dependent elements 72 and 74 to establish a hand grip portion for enabling grasping of the handle 8 and lifting of the can 10. A pair of suspending members 80 and 82 are spaced apart the given distance between the trunnions 12 and 14 as shown in FIG. 12, in order to pivotally engage them, and include the elongated elements 44 and 50, the intermediate elements 60 and 66, the dependent elements 72 and 74, and the hook-shaped elements 56 and 58, the pair of suspending members 80 and 82 establishing a hook structure for securely engaging the ladder rung 34 to suspend the can 10 from the ladder rung 34 as shown in FIGS. 1 and 6. The suspending members 80 and 82 have a length between the intermediate elements 60 and 66 and the pivotal attachment means, which are the hook-shaped elements 56 and 58, sufficient to suspend the can 10 from the ladder rung 34 with the bottom 20 of the can 10 resting upon the adjacent lower rung 36 as shown in FIG. 1, to further support and stabilize the can 10 in an upright position and preclude spilling paint 42 when the can 10 is full. The suspending members 80 and 82 have a length between the intermediate elements 60 and 66 and the pivotal attachment means, which are the hook-shaped elements 56 and 58, sufficient to suspend the can 10 from the ladder rung 34 with the front wall 16 of the can 10 resting against the adjacent lower rung 36 as shown in FIG. 6 to further stabilize the can 10 in an inclined position to gain easier access to the can 10 and to preclude spilling paint 42 when the can 10 is partially full. The length of the suspending members 80 and 82 between the intermediate elements 60 and 66 and the pivotal attachment means, which are the hook-shaped elements 56 and 58, is within the range of four to seven inches (102 to 178 mm).

Referring now to FIGS. 7 through 10, another handle constructed in accordance with the invention is shown at 90. Handle 90 is very similar to the above-described handle 8 in that is has a pair of elongated elements 92 and 98 that have upper ends 94 and 100 and opposite lower ends 96 and 102, are generally parellel to each other, and are disposed generally vertically when the handle 90 is suspended from the ladder rung 34 for use. Attached to the lower ends 96 and 102 of elongated elements 92 and 98 are hook-shaped elements 104 and 106 comprising means for pivotal attachment that engage the trunnions 12 and 14 respectively. Intermediate element 108 has first end 110 and opposite second end 112. The first end 110 is attached to the upper end 94 of the elongated element 92. Intermediate element 114 has first end 116 and opposite second end 118. The first end 116 is attached to the upper end 100 of elongated element 98. The intermediate elements 108 and 114 are disposed generally horizontally and are straight and generally parallel to each other. Dependent element 120 is connected to second end 112 of intermediate element 108. Dependent element 122 is connected to second end 118 of intermediate element 114.

In the present handle 90, however, the dependent elements 108 and 114 are straight, are generally vertical and lie within the same plane. Transverse member 124 is disposed horizontally below the second ends 112 and 118 of intermediate elements 108 and 114 and is connected between the dependent elements 120 and 122 to establish a hand grip portion. As in handle 8, a pair of suspending members 126 and 128 are spaced apart the given distance between the trunnions 12 and 14 in order to pivotally engage them, and include the elongated elements 92 and 98, the intermediate elements 108 and 114, the dependent elements 120 and 122, and the hook-shaped elements 104 and 106, the pair of suspending members 126 and 128 establishing a hook structure for securely engaging the ladder rung 34 to suspend the can 10 from the ladder rung 34.

Figure 23:
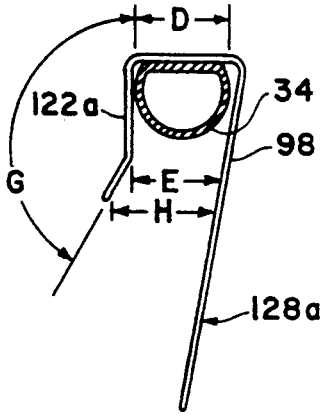
FIG. 23 is a left side view of a variation of the handle of FIG. 7 engaging the extension ladder rung which is shown in cross-section.
Figure 24:
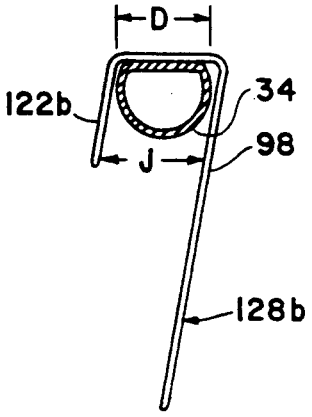
FIG. 24 is a left side view of another variation of the handle of FIG. 7 engaging the extension ladder rung which is shown in cross-section.
Figure 25:
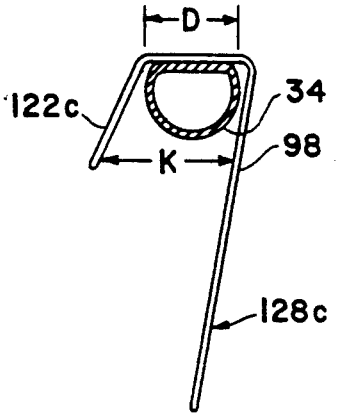
FIG. 25 is a left side view of still another variation of the handle of FIG. 7 engaging the extension ladder rung which is shown in cross-section.
Figure 28:
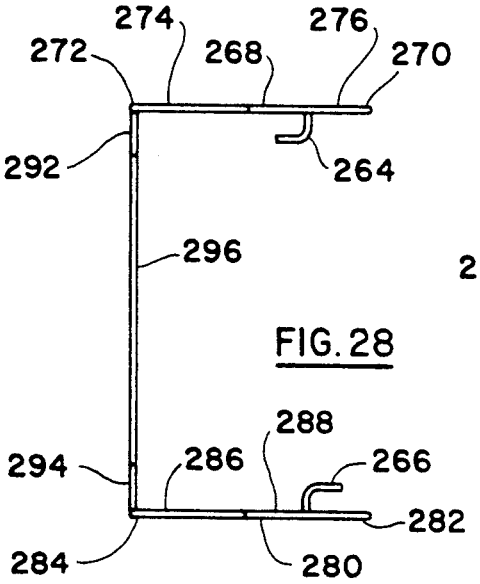
FIG. 28 is a top view of the handle of FIG. 26.
Figure 29:
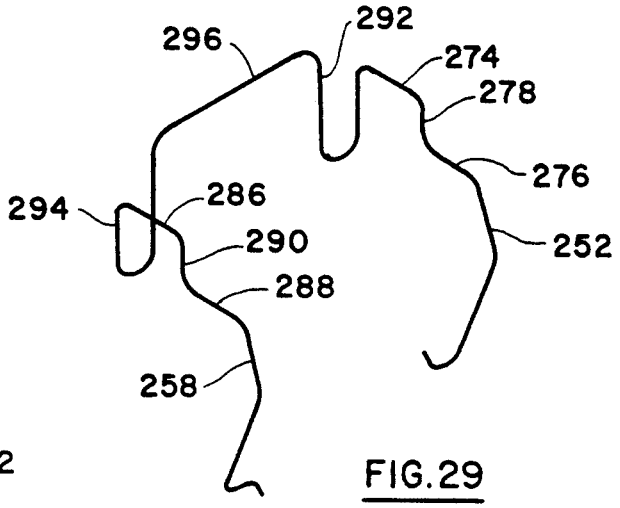
FIG. 29 is an isometric view of the handle of FIG. 26.
Figure 27:
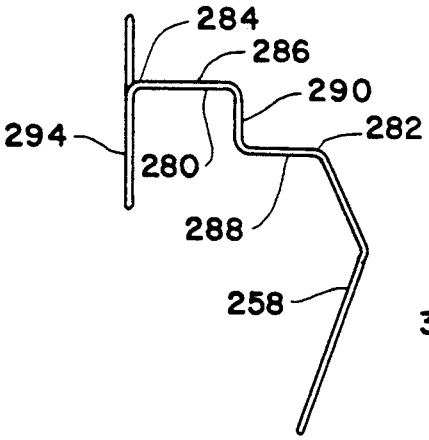
FIG. 27 is a left side view of the handle of FIG. 26.
Figure 26:
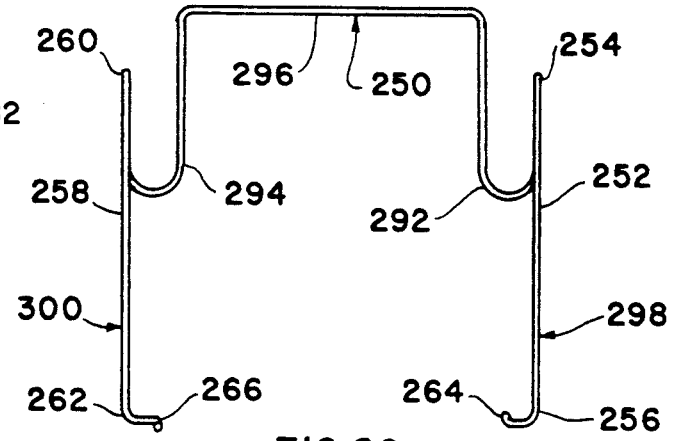
FIG. 26 is a front elevational view of an additional handle constructed in accordance with the invention.

FIGS. 23, 24, and 25 show left side views of three variations of handle 90. In FIG. 23, distance E is less than distance D, therefore a first plane in which elongated element 98 lies, and a second plane in which dependent element 122*a* lies, converge downward in close cooperation with the ladder rung 34 to retain the hook structure of the suspending member 128*a* on the rung 34 against accidental disengagement. The structure is resilient enough to allow dependent element 122*a* to spring outward sufficiently to install the handle 90 on the rung 34. The lower end of dependent element 122*a* projects outward at an obtuse angle G from the plane in which the dependent element 122*a* lies, so that distance H is greater than distance E, to facilitate initial engagement of the suspending member 128*a* onto the ladder rung 34. In FIG. 24, distance J is equal to distance D, and thus the first plane and the second plane are parallel. In FIG. 25, distance K is greater than distance D, and thus the first plane and the second plane converge upward.

Turning now to FIGS. 13 through 18, a further handle constructed in accordance with the invention is shown at 130. Handle 130 is similar in operation to the above-described handles 8 and 90, but differs in that it is configured to engage both extension ladders and step ladders, the step ladders having rungs of greater width than those of extension ladders. Elongated elements 132 and 138 are generally vertical when in use, and have upper ends 134 and 140 and opposite lower ends 136 and 142 to which are attached hook-shaped elements 144 and 146, comprising means for pivotal attachment to the trunnions 12 and 14 respectively. Intermediate element 148 has first end 150 and opposite second end 152. First end 150 is connected to upper end 134 of elongated element 132. Intermediate element 148 includes a lower straight portion 154 and an upper straight portion 156, both horizontal, connected by a generally vertical portion 158. Intermediate element 160 has first end 162 and opposite second end 164. First end 162 is connected to upper end 140 of elongated element 138. Intermediate element 160 includes a lower straight portion 166 and an upper straight portion 168, both horizontally, connected by a generally vertical portion 170. Dependent element 172 is connected to second end 152 of intermediate element 148. Dependent element 174 is connected to second end 164 of intermediate element 160. The dependent elements 172 and 174 are U-shaped, are generally vertical, and lie within the same plane. Transverse member 176 is disposed horizontally above the second ends 152 and 164 of the intermediate elements 148 and 160 and is connected between the dependent elements 172 and 174 to establish a hand grip portion. A pair of suspending members 178 and 180 are spaced apart the given distance between the trunnions 12 and 14, and include the elongated elements 132 and 138, the intermediate elements 148 and 160, the dependent elements 172 and 174, and the hook-shaped elements 144 snd 146, the pair of suspending members 178 and 180 establishing a hook structure.

Figure 17:
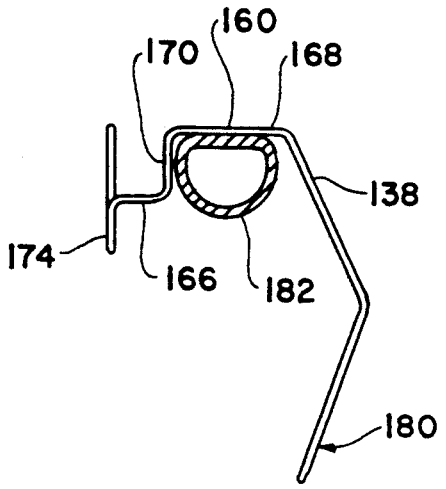
FIG. 17 is a left side elevational view of the handle of FIG. 13 engaging a rung of an extension ladder, which is shown in cross-section.
Figure 18:
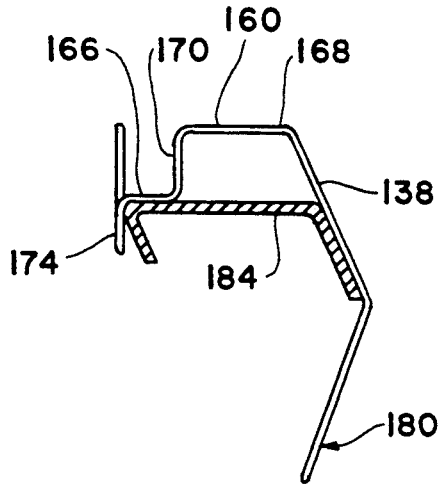
FIG. 18 is a left side elevational view of the handle of FIG. 13 engaging a rung of a step ladder, which is shown in cross-section.
Figure 21:
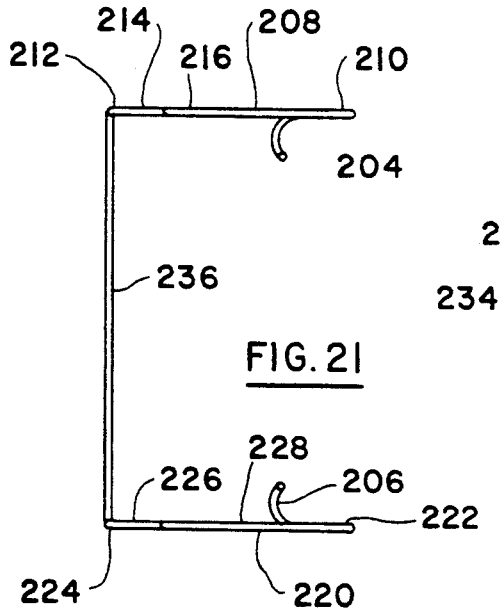
FIG. 21 is a top view of the handle of FIG. 19.
Figure 22:
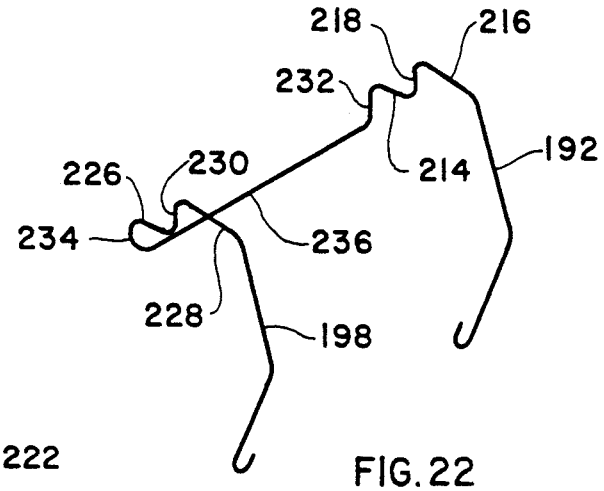
FIG. 22 is an isometric view of the handle of FIG. 19.
Figure 20:
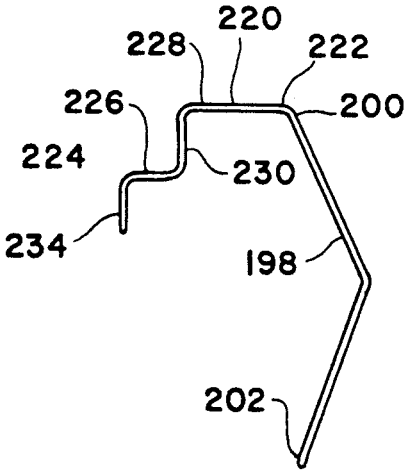
FIG. 20 is a left side view of the handle of FIG. 19.
Figure 19:
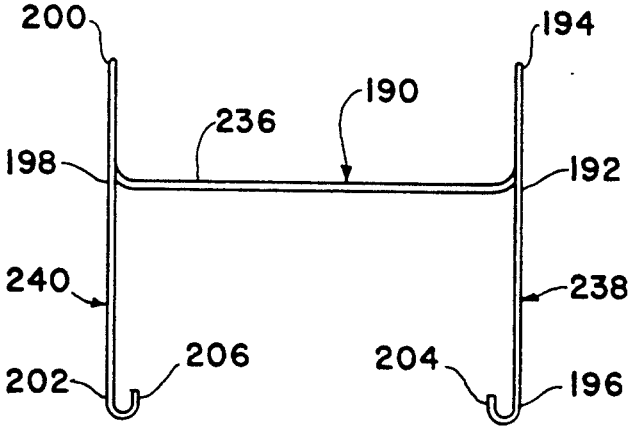
FIG. 19 is a front elevational view of yet another handle constructed in accordance with the invention.

In FIG. 17, an extension ladder rung, shown in cross-section at 182, supports suspending member 180, and is engaged by upper portion 168 and vertical portion 170 of intermediate element 160, and by elongated element 138. In FIG. 18, a step ladder rung, shown in cross-section at 184, supports suspending member 180, and is engaged by lower portion 166 of intermediate element 160, by dependent element 174, and by elongated element 138.

A still further embodiment of the invention, similar to the above-described handle 130, is illustrated in FIGS. 19 through 22 wherein a handle 190 is shown with elongated elements 192 and 198 having upper ends 194 and 200 and opposite lower ends 196 and 202, to which are attached hook-shaped elements 204 and 206 respectively. Intermediate elements 208 has first end 210 and opposite second end 212. First end 210 is connected to upper end 194 of elongated element 192. Intermediate element 208 includes a lower straight portion 214 and an upper straight portion 216, both horizontal, connected by a generally vertical portion 218. Intermediate element 220 has first end 222 and opposite second end 224. First end 222 is connected to upper end 200 of elongated elements 198. Intermediate element 220 includes a lower straight portion 226 and an upper straight portion 228, both horizontal, connected by a generally vertical portion 230. Dependent element 232 is connected to second end 212 of intermediate element 208. Dependent element 234 is connected to second end 224 of intermediate element 220. Dependent elements 232 and 234 are straight, are generally vertical, and lie within the same plane. Transverse member 236 is disposed horizontally below the second ends 212 and 224 of the intermediate elements 208 and 220 and is connected between the dependent elements 232 and 234 to establish a hand grip portion. A pair of suspending members 238 and 240 are spaced apart the given distance between the trunnions 12 and 14, and include the elongated elements 192 and 198, the intermediate elements 208 and 220, the dependent elements 232 and 234, and the hook-shaped elements 204 and 206, the pair of suspending members 238 and 240 establishing a hook structure.

Figure 30:
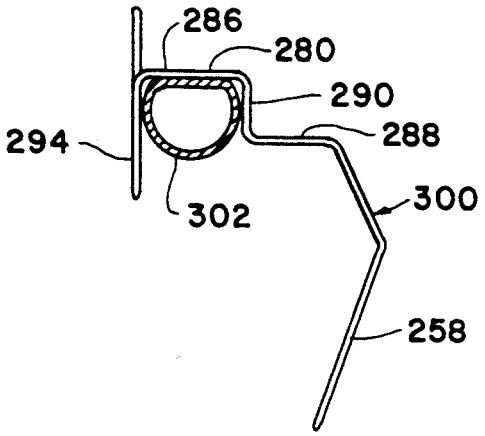
FIG. 30 is a left side view of the handle of FIG. 26 engaging a rung of an extension ladder which is shown in cross-section.
Figure 31:
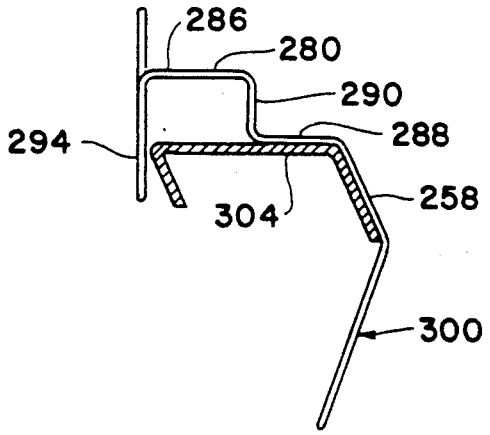
FIG. 31 is a left side view of the handle of FIG. 26 engaging a rung of a step ladder which is shown in cross-section.
Figure 34:
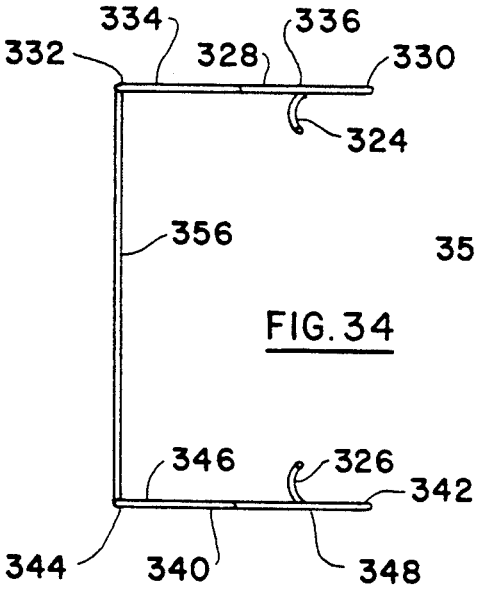
FIG. 34 is a top view of the handle of FIG. 32.
Figure 35:
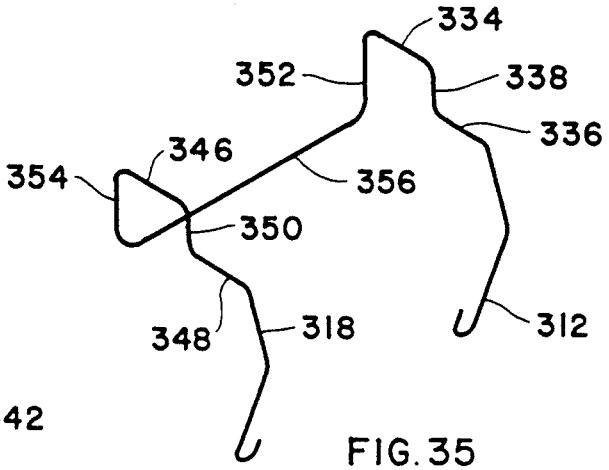
FIG. 35 is an isometric view of the handle of FIG. 32.
Figure 33:
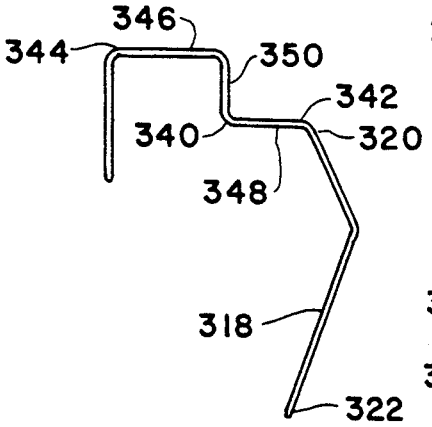
FIG. 33 is a left side view of the handle of FIG. 32.
Figure 32:
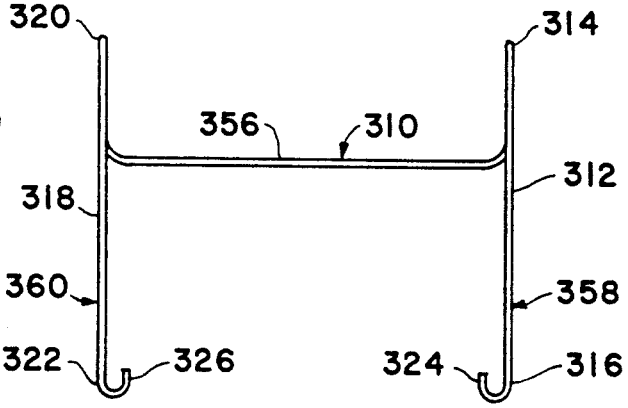
FIG. 32 is yet an additional handle constructed in accordance with the invention.

Turning now to FIGS. 26 through 31, yet another handle constructed in accordance with the invention is shown at 250, wherein a pair of elongated elements 252 and 258 have upper ends 254 and 260, and opposite lower ends 256 and 262, to which are attached hook-shaped elements 264 and 266, respectively. Intermediate element 268 has first end 270 and opposite second end 272. First end 270 is connected to upper end 254 of elongated element 252. Intermediate element 268 includes an upper straight portion 274 and a lower straight portion 276, both horizontal, connected by a generally vertical portion 278. Intermediate element 280 has first end 282 and opposite second end 284. First end 282 is connected to upper end 260 of elongated element 258. Intermediate element 280 includes an upper straight portion 286 and a lower straight portion 288, both horizontal, connected by a generally vertical portion 290. Dependent element 292 is connected to second end 272 of intermediate element 268. Dependent element 295 is connected to second end 284 of intermediate element 280. The dependent elements 292 and 294 are U-shaped, are generally vertical, and lie within the same plane. Transverse member 296 is disposed horizontally above the second ends 272 and 284 of the intermediate elements 168 and 180 and is connected between the dependent elements 292 and 294 to establish a hand grip portion. A pair of suspending members 298 and 300 are spaced apart the given distance between the trunnions 12 and 14, and include the elongated elements 252 and 258, the intermediate elements 268 and 280, the dependent elements 292 and 294, and the hook-shaped elements 264 and 266, the pair of suspending members 298 and 300 establishing a hook structure. In FIG. 30 an extension ladder rung, shown in cross-section at 302, supports suspending member 300 and is engaged by upper portion 286 and vertical portion 290 of intermediate element 280, and by dependent element 294. In FIG. 31 a step ladder rung, shown in cross-section at 304, supports suspending member 300 and is engaged by lower portion 288 of intermediate element 280, by dependent element 294, and by elongated element 258.

Yet another embodiment of the invention is depicted in FIGS. 32 through 35, wherein a handle 310 has elongated elements 312 and 318 with upper ends 314 and 320, and opposite lower ends 316 and 322 to which are attached hook-shaped elements 324 and 326, respectively. Intermediate element 328 has first end 330 and opposite second end 332. First end 330 is connected to upper end 314 of elongated element 312. Intermediate element 328 has an upper straight portion 334 and a lower straight portion 336, both horizontal, connected by a generally vertical portion 388. Intermediate element 340 has first end 342 and opposite second end 344. First end 342 is connected to upper end 320 of elongated element 318. Intermediate element 340 has an upper straight portion 346 and a lower straight portion 348, both horizontal, connected by a generally vertical portion 350. Dependent element 352 is connected to second end 332 of intermediate element 328. Dependent element 354 is connected to second end 344 of intermediate element 340. Dependent elements 352 and 354 are straight, are generally vertical, and lie within the same plane. Transverse member 356 is disposed horizontally below the second ends 332 and 344 of the intermediate elements 328 and 340. The transverse member 356 is connected between the dependent elements 352 and 354 to establish a hand grip portion. A pair of suspending members 258 and 360 are spaced apart the given distance between the trunnions 12 and 14, and include the elongated elements 312 and 318, the intermediate elements 328 and 340, the dependent elements 352 and 354, and the hook-shaped elements 324 and 326, the pair of suspending members 358 and 360 establishing a hook structure.

The preferred material for use in construction of the invention is resilient wire made of a metal such as steel, although a polymer such as nylon may be used.

It is to be understood that the above detailed description of embodiments of the invention is provided for example only. Various details of design and construction may be changed without departing from the true spirit and scope of the invention as set forth in the appended claims.

The embodiments of the invention in which an exclusive property or privilege is claimed are defined as follows:

1. A handle for use in connection with a paint can having two opposite side support trunnions spaced apart a given distance to suspend the paint can from a ladder including at least one ladder rung having a flat surface of a predetermined width, the ladder having a front and a rear, the handle comprising:

(a) a pair of suspending members spaced apart the given distance between the trunnions, the pair of suspending members establishing a hook structure for securely engaging the ladder rung to suspend the can from the ladder rung from the front of the ladder, the pair of suspending members including (b) a pair of elongated elements, disposed generally vertically at the front of the ladder, each of the elongated elements having opposite upper and lower ends;

(c) a pair of generally horizontal intermediate elements, of sufficient length to straddle the width of the ladder rung, each intermediate element having a first end for placement adjacent the front of the ladder and a second end opposite the first end for placement adjacent the rear of the ladder, the first ends extending toward corresponding second ends, the first ends being attached to corresponding upper ends of the elongated elements, and the intermediate elements being straight to enable secure engagement with the flat surface of the rung of the ladder;

(d) a pair of generally vertical dependent elements connected to the second ends of the intermediate elements for placement adjacent the rear of the ladder;

(e) pivotal means for pivotal attachment of the lower ends of the elongated elements to the trunnions so that upon such attachment the handle will be pivoted from a lower position wherein the handle is folded against the can for storage to an upper position wherein the handle is away from the can for installation upon the rung from the front of the ladder for use; and (f) a transverse member disposed horizontally between the suspending members and connecting the suspending members to establish a hand grip portion for enabling grasping of the handle and lifting of the can.

2. The handle of claim 1 wherein the suspending members have a length between the intermediate elements and the pivotal attachment means sufficient to suspend the can from the ladder rung with the bottom of the can resting upon an adjacent lower rung to further support and stabilize the can in an upright position and preclude spilling paint when the can is full.

3. The handle of claim 2 wherein the suspending members have a length between the intermediate elements and the pivotal attachment means sufficient to suspend the can from the ladder rung with the front wall of the can resting against the adjacent lower rung to further stabilize the can in an inclined position to gain easier access to the can and preclude spilling paint when the can is partially full.

4. The handle of claim 3 wherein the length of the suspending members between the intermediate elements and the pivotal attachment means is within the range of four to seven inches (102 to 178 mm).

5. The handle of claim 4 wherein each intermediate element of the pair of intermediate elements is at least one and one-half inches (38 mm) in length.

6. The handle of claim 1 wherein the pivotal means includes a pair of hook-shaped elements attached to the lower ends of the elongated elements for insertion into the trunnions.

7. The handle of claim 5 wherein:

(a) the elongated elements lie within a first plane; and (b) the dependent elements lie within a second plane.

8. The handle of claim 7 wherein the first plane and the second plane converge upward.

9. The handle of claim 7 wherein the first plane and the second plane are parallel.

10. The handle of claim 7 wherein the first plane and the second plane converge downward in close cooperation with the ladder rung to retain the hook structure of the suspending members on the rung against accidental disengagement.

11. The handle of claim 10 wherein the lower ends of the dependent elements project outward at an obtuse angle from the plane in which the dependent elements lie, to facilitate initial engagement of the suspending members onto the ladder rung.

12. The handle of claim 5 wherein the transverse member is disposed above the intermediate elements, the pair of dependent elements are each U-shaped, and the dependent elements connect the intermediate elements to the transverse member.

13. The handle of claim 5 wherein the transverse member is disposed below the intermediate elements, the pair of dependent elements are straight, and the dependent elements connect the intermediate elements to the transverse member.

14. The handle of claim 5 wherein the pair of intermediate elements each further comprise an upper and a lower straight portion and a generally vertical portion connecting the upper portion to the lower portion.

15. The handle of claim 14 wherein the transverse member is disposed above the intermediate elements, the pair of dependent elements are each U-shaped, and the dependent elements connect the intermediate elements to the transverse member.

16. The handle of claim 14 wherein the transverse member is disposed below the intermediate elements, the pair of dependent elements are straight, and the dependent elements connect the intermediate elements to the transverse member.

17. A handle made of resilient wire for use in connection with a paint can having two opposite side support trunnions spaced apart a given distance to suspend the paint can from a ladder including at least one ladder rung having a flat surface of a predetermined width, the ladder having a front and a rear, the handle comprising:

(a) a pair of suspending members spaced apart the given distance between the trunnions, the pair of suspending members establishing a hook structure for securely engaging the ladder rung to suspend the can from the ladder rung from the front of the ladder, the pair of suspending members including (b) a pair of elongated elements, disposed generally vertically at the front of the ladder, each of the elongated elements having opposite upper and lower ends;

(c) a pair of generally horizontal intermediate elements, of sufficient length to straddle the width of the ladder rung, each intermediate element having a first end for placement adjacent the front of the ladder and a second end opposite the first end for placement adjacent the rear of the ladder, the first ends extending toward corresponding second ends, the first ends being attached to corresponding upper ends of the elongated elements, and the intermediate elements being straight to enable secure engagement with the flat surface of the rung of the ladder;

(d) a pair of U-shaped, generally vertical dependent elements connected to the second ends of the intermediate elements for placement adjacent the rear of the ladder;

(e) a pair of hook-shaped elements attached to the lower ends of the elongated elements for pivotal engagement with the trunnions so that upon such engagement the handle will be pivoted from a lower position wherein the handle is folded against the can for storage to an upper position wherein the handle is away from the can for installation upon the rung from the front of the ladder for use;

(f) a transverse member disposed horizontally above the second ends of the intermediate elements, the transverse member connecting the dependent elements to establish a hand grip portion for enabling grasping of the handle and lifting of the can;

(g) the suspending members having a length between the intermediate elements and the hook-shaped elements sufficient to suspend the can from the ladder rung with the bottom of the can resting upon an adjacent lower rung to further support and stabilize the can in an upright position and preclude spilling paint when the can is full;

(h) the suspending members having a length between the intermediate elements and the hook-shaped elements sufficient to suspend the can from the ladder rung with the front wall of the can resting against the adjacent lower rung to further stabilize the can in an inclined position to gain easier access to the can and preclude spilling paint when the can is partially full;

(i) a first plane containing the elongated elements and a second plane containing the dependent elements, the first plane and the second plane converging downward in close cooperation with the ladder rung to retain the hook structure of the suspending members on the rung against accidental disengagement; and (j) the lower ends of the dependent elements projecting outward at an obtuse angle from the plane in which the dependent elements lie, to facilitate initial engagement of the suspending members onto the ladder rung.

18. A handle made of resilient wire for use in connection with a paint can having two opposite side support trunnions spaced apart a given distance to suspend the paint can from a ladder rung having a predetermined width, the handle comprising:

(a) a pair of suspending members spaced apart the given distance between the trunnions, the pair of suspending members including (b) a pair of elongated elements, disposed generally vertically, each having opposite upper and lower ends;

(c) a pair of straight, generally horizontal intermediate elements, of sufficient length to straddle the width of the ladder rung, each intermediate element having first and second opposite ends, the first ends being attached to the upper ends of the elongated elements;

(d) a pair of straight, generally vertical dependent elements connected to the second ends of the intermediate elements;

(e) a pair of hook-shaped elements attached to the lower ends of the elongated elements for pivotal engagement with the trunnions so that the handle will be pivoted from a lower position wherein the handle is folded against the can for storage to an upper position wherein the can is suspended from the rung for use;

(f) a transverse member disposed horizontally below the second ends of the intermediate elements, the transverse member connecting the dependent elements to establish a hand grip portion for enabling grasping of the handle and lifting of the can;

(g) the suspending members having a length between the intermediate elements and the hook-shaped elements sufficient to suspend the can from the ladder rung with the bottom of the can resting upon an adjacent lower rung to further support and stabilize the can in an upright position and preclude spilling paint when the can is full;

(h) the suspending members having a length between the intermediate elements and the hook-shaped elements sufficient to suspend the can from the ladder rung with the front wall of the can resting against the adjacent lower rung to further stabilize the can in an inclined position to gain easier access to the can and preclude spilling paint when the can is partially full;

(i) a first plane containing the elongated elements and a second plane containing the dependent elements, the first plane and the second plane converging downward in close cooperation with the ladder rung to retain the hook structure of the suspending members on the rung against accidental disengagement; and (j) the lower ends of the dependent elements projecting outward at an obtuse angle from the plane in which the dependent elements lie, to facilitate initial engagement of the suspending members onto the ladder rung.

* * * * *